United States Patent [19]

Nagle et al.

[11] Patent Number: 4,969,766

[45] Date of Patent: Nov. 13, 1990

[54] CAP FOR MARKING INSTRUMENTS

[75] Inventors: George J. Nagle, Phillipsburg, N.J.; Harry J. Lidle, Jr., Macungie; Charles W. Dietterich, Brodheadsville, both of Pa.

[73] Assignee: Binney & Smith, Inc., Easton, Pa.

[21] Appl. No.: 311,143

[22] Filed: Feb. 15, 1989

[51] Int. Cl.[5] ..... B43K 5/00

[52] U.S. Cl. ..... 401/202; 401/213

[58] Field of Search ..... 401/98, 202, 213, 243–248, 401/269, 104–106; 24/10 R, 10 A, 11 R–11 P; D19/56–58

[56] References Cited

U.S. PATENT DOCUMENTS

| | | | |
|---|---|---|---|
| 3,463,323 | 4/1967 | Riepe | 401/243 X |
| 3,463,597 | 4/1969 | Wakai | 401/202 X |

FOREIGN PATENT DOCUMENTS

| | | | |
|---|---|---|---|
| 204252 | 12/1986 | European Pat. Off. | 401/243 |
| 2356981 | 5/1974 | Fed. Rep. of Germany | 401/245 |
| 2174374 | 11/1986 | United Kingdom | 401/243 |

*Primary Examiner*—Richard J. Apley
*Assistant Examiner*—D. F. Crosby
*Attorney, Agent, or Firm*—Neuman, Williams, Anderson & Olson

[57] ABSTRACT

A cap for use with marking instruments having a barrel which carries at one end a marking nib. The cap comprises a generally cylindrical shell which is open at both ends. A conical shaped nib sealing element is disposed within the interior of the shell and spaced from each end thereof. The nib sealing element is adapted to fit over and seal the marking nib and is spaced from the cap shell to permit air to pass therebetween.

6 Claims, 1 Drawing Sheet

FIG. 1
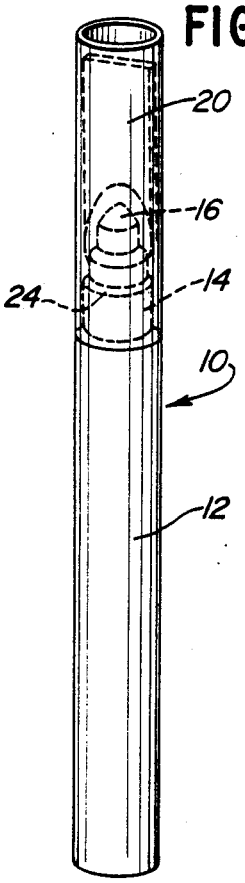
FIG. 2
PRIOR ART
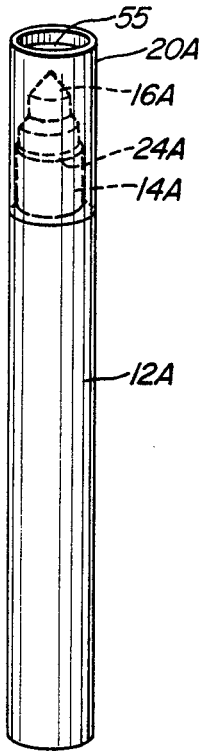
FIG. 7
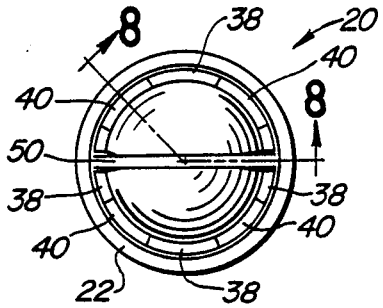
FIG. 8
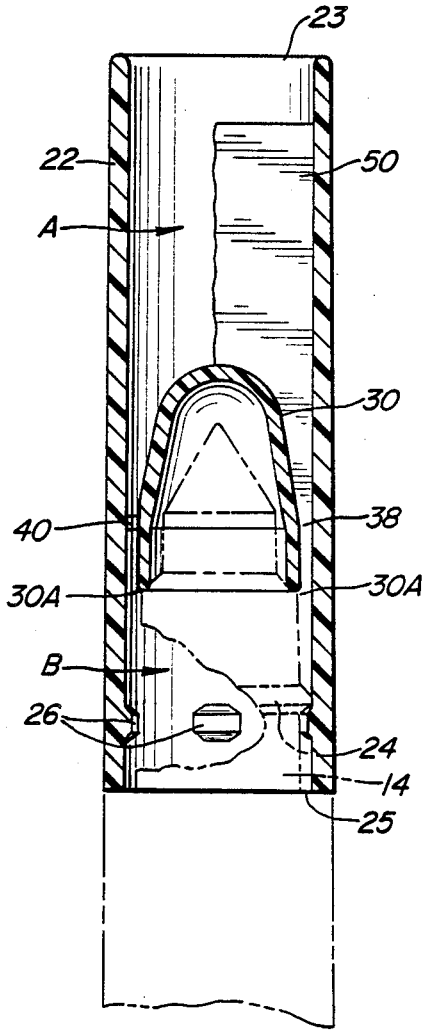
FIG. 4
PRIOR ART
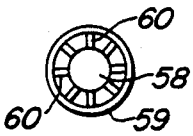
FIG. 6
PRIOR ART
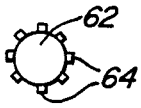
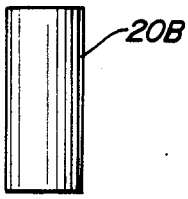
FIG. 3
PRIOR ART
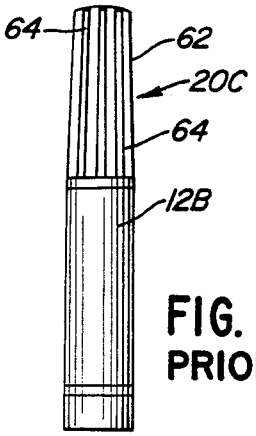
FIG. 5
PRIOR ART

CAP FOR MARKING INSTRUMENTS

This invention relates to marking instruments and more particularly to marking instruments such as felt tip markers, high-light marking instruments and the like.

BACKGROUND OF THE INVENTION

Caps are provided on current marking instruments to enclose and protect the marking tip and prevent it from drying out and usually the marking instrument is adapted to hold the cap when it is removed from the tip.

However, the caps when removed are not always placed on the marking instruments but are sometimes placed in the mouth of the user. This practice is dangerous since the cap may become lodged in the throat, possibly resulting in asphyxiation. This problem is more prevalent with children. Prior art markers have addressed this problem, but with less than satisfactory success.

OBJECTS OF THE INVENTION

It is therefore a principal object of this invention to provide a novel cap design for marking instruments which permits breathing if accidentally ingested and lodged in one's throat.

It is another object of this invention to provide a novel cap for marking instruments which provides good sealing of the tip or nib of marking instruments and which provides safety advantages.

SUMMARY OF THE INVENTION

The present invention provides a cap for marking instruments such as felt-tip crayon markers such as Crayola® markers in which the marking nib is effectively enclosed and sealed and which cap is ventilated so that air can pass therethrough when it is removed from the writing instrument. This is a very desirable safety feature under circumstances where the cap is accidentally ingested by a user. The novel cap of the invention is particularly adapted for use with marking instruments having a barrel which carries at one end a marking nib. The cap comprises a generally cylindrical shell which is open at both ends. A conical shaped nib sealing element is disposed within the interior of the shell and spaced from each end thereof. The nib sealing element is adapted to fit over and seal the marking nib and is spaced from the cap shell to permit air to pass therebetween.

DESCRIPTION OF THE DRAWINGS

The advantages of the present invention will be apparent from the following description taken in conjunction with the drawings wherein:

FIG. 1 is a perspective view of a marking instrument having a cap in accordance with this invention and showing in dotted lines a felt marking tip in a chamfered holder therefor.

FIG. 2 is a perspective view of a typical prior art marking instrument having a conventional cap.

FIG. 3 is a side view of another prior art cap for a marking instrument.

FIG. 4 is a plan view of the prior art cap of FIG. 3.

FIG. 5 is a side view of another prior art cap for a marking instrument.

FIG. 6 is a plan view of the prior art cap of FIG. 5.

FIG. 7 is a plan view of a cap for a marking instrument in accordance with this invention.

FIG. 8 is a vertical sectional view of the cap in accordance with this invention taken on the line 8-8 of FIG. 7.

DESCRIPTION OF PREFERRED EMBODIMENTS

Referring to FIG. 1, a marking instrument 10, such as a felt-tip marker, is comprised of a barrel portion 12 which carries at its upper end a chamfered tip-holder 14 which slidably engages and holds cap 20 on the instrument. A marking nib 16, such as a felt-tip nib, is secured within the tip-holder 14. The novel cap 20 of this invention encloses and protects the marking nib 16.

The cap 20 is comprised of a generally cylindrical shell 22 which is open at both the top 23 and bottom 25. The circumference of shell 22 matches that of barrel 12 adapting it to be engaged on the point end of the barrel 12. An annular bead 26 located circumferentially around the interior of shell 22 engages an annular bead 24 on chamfered tip-holder 14. The annular bead 26 engages bead 24 in snap-fit manner to securely hold the cap on the writing instrument yet permit it to be easily removed therefrom. A conical nib seal 30 is located within the interior of shell 22 and is spaced therefrom to permit air to pass therebetween. The nib seal 30 is joined to the interior of shell 22 by the horizontal annular shelf 40. A number of air ports 38 are spaced circumferentially around shelf 40 so that when the cap is removed from the marking instrument air can flow freely between zones A and B. The nib seal 30 is conical with the open edge 30A being flexible so as to easily engage the chamfered tip-holder 14 carried by barrel 12. In this manner, nib seal 30 fits snugly over and forms a tight seal with the tip-holder 14 so as to effectively prevent the marking nib 16 from drying out. Because of the flexible edge 30A, the design accommodates the dimensional variation normally inherent in multi-cavity tools.

The nib seal 30 is of a size and is disposed within shell 22 at a vertical position such that it mates with tip-holder 14 to form a sheath-like enclosure which effectively seals and protects marking nib 16. Similarly, the nib seal 30 is recessed within the shell 22 away from top end 23.

The air ports 38 in the annular shelf 40 between shell 22 and nib seal 30 permit air to flow through the cap so as to prevent asphyxiation if accidentally lodged in a person's throat. It is preferred that the spacing and size of the air ports 38 be such so as to maximize the air flow through the cap. Preferably, the air flow through the cap in both directions should be at least about 8 liters per minute with less than about 1.33 kilopascals maximum pressure drop.

For example, the length of cap 20 is approximately 1.78 inches in length with an external diameter of 0.57 inch, with four air ports being equidistantly spaced around the exterior of the nib seal, each port being approximately 0.005 square inch. The nib seal 30 is recessed within shell 22 and in a preferred construction the apex of the nib seal 30 is approximately 0.75 inch from the top surface 23 of cap 20. The cap 20 can be formed, as well known in the art, in one piece, for example by injection molding of known plastics such as polyethylene and the like.

A preferred but optional element is a thin brace 50 within the upper portion of shell 22 which extends transversely across the diameter of the shell. The diametrically extending brace 50 reinforces the rigidity of the cap 20 and also prevents the wrong end of the cap from being inadvertently placed on the writing instrument.

The advantages of the cap of this invention both with respect to safety and nib sealing are readily apparent in contrast to prior art caps.

Thus, FIG. 2 illustrates a typical writing instrument having a barrel 12A and a cap 20A. As can be seen, the cap 20A is integrally sealed by top 55 and thus air cannot pass through the cap and thus the cap completely lacks the safety advantages of the cap of the invention. Also, the prior art cap of FIG. 2 is merely a cylinder and does not have any member which intimately surrounds and seals marking nib 16A as does the nib seal 30 in the cap of this invention.

Another prior art cap for marking instruments is illustrated in FIGS. 3 and 4. The cap 20B is basically a cylinder within a cylinder. The internal cylinder 58 is attached to the outer cylinder 59 by a plurality of spokes 60. The internal cylinder is joined to the barrel by surface contact to protect the writing tip. However, close tolerances must be met for the internal cylinder 58 to fit correctly on the barrel and if the cylinder is out of round proper sealing is not achieved. Moreover, the internal cylinder 58 is flush with the top of the cap which creates a restricted flow path subject to being sealed off by mucous secretion if lodged within a person's throat.

Another prior art cap for marking instruments is illustrated in FIGS. 5 and 6. Thus, cap 20C is in the form of tapered cylinder 62 having a plurality of circumferentially arranged splines 64 on the outer surface. Again, this cap relies on surface contact of the cap with the barrel for sealing and thus requires adherence to close tolerances in manufacturing. Also, if swallowed the throat membranes could adhere and conform to the splines rendering them ineffective with respect to passage of air.

Those modifications and equivalents which fall within the spirit of the invention are to be considered a part thereof.

What is claimed is:

1. A cap for a marking instrument, which instrument has a barrel which carries a marking nib, said cap comprising a generally cylindrical shell open at both ends having a circumference substantially matching that of the barrel of the marking instrument, a conical shaped nib sealing element within and spaced from each end of said shell, said nib sealing element being adapted to fit over and seal said marking nib and being spaced from said shell to provide passage for air therebetween, said cap having a transverse thin rib in the upper portion which prevents the wrong end of the cap being placed on the marking instrument.

2. A cap for a marking instrument, which instrument has a barrel which arries a marking nib, said cap comprising a generally cylindrical shell open at both ends having a circumference substantially matching that of the barrel of the marking instrument, a conical shaped nib sealing element fixed at a point spaced from each end of the sealing elements within and spaced from each end of said shell, said nib sealing element being adapted to fit over and seal said marking nib and being spaced from said shell to provide passage for air therebetween.

3. A cap for a marking instrument in accordance with claim 2, wherien the conical shaped nib sealing element has a flexible open end portion to facilitate placement of the cap on the marking instrument.

4. A cap for a marking instrument in accordance with claim 2 wherein the nib sealing element is attached to the interior of the shell by a shelf member having a plurality of spaced ports therein to permit passage of air.

5. A cap for a marking instrument, which instrument has a barrel which carries a chamfered nib holder and marking nib, said cap comprising a generally cylindrical shell open at both ends having a circumference substantially matching that of the barrel of the marking instrument, a conical shaped nib sealing element fixed at a point spaced from each end of the sealing element within and spaced from each end of said shell, said nib sealing element being adapted to fit over and engage the chamfered nib holder and seal and being spaced from said shell to provide passage for air therebetween.

6. A cap for a marking instrument in accordance with claim 5 having an annular bead on the interior surface of said cylindrical shell adapted for snap-fit sealing engagement with an annular bead on the chamfered nib holder.

* * * * *

UNITED STATES PATENT AND TRADEMARK OFFICE

CERTIFICATE OF CORRECTION

PATENT NO. : 4,969,766

DATED : November 13, 1990

INVENTOR(S) : GEORGE J. NAGLE, HARRY J. LIDLE, JR. and CHARLES W. DIETTERICH

It is certified that error appears in the above-identified patent and that said Letters Patent is hereby corrected as shown below:

Column 4, line 10, "arries" should be -- carries -- line 15, "elements" should be -- element, -- line 35, after "element" insert a comma (,)

line 38, after "seal" insert -- said marking nib --

Signed and Sealed this

Fifth Day of May, 1992

*Attest:*

DOUGLAS B. COMER

*Attesting Officer*

*Acting Commissioner of Patents and Trademarks*